US005648645A

United States Patent [19]

Arpagaus et al.

[11] Patent Number: 5,648,645

[45] Date of Patent: Jul. 15, 1997

[54] ELEVATOR EXCESS SPEED DETECTOR WITH MULTIPLE LIGHT BARRIER

[75] Inventors: Christian Arpagaus, Landquart; Bernhard Gerstenkorn, Kierikon; Daniel Zäch, Trimmis, all of Switzerland

[73] Assignee: Inventio AG, Hergiswil, Switzerland

[21] Appl. No.: 561,088

[22] Filed: Nov. 20, 1995

[30] Foreign Application Priority Data

Nov. 18, 1994 [CH] Switzerland ..... 03475/94

[51] Int. Cl.[6] ..... B66B 5/06; B66B 1/34

[52] U.S. Cl. ..... 187/393; 187/386; 187/387; 187/282

[58] Field of Search ..... 187/394, 393, 187/287, 286, 291, 282

[56] References Cited

U.S. PATENT DOCUMENTS 4,434,874 3/1984 Caputo ..... 187/29 R
4,499,974 2/1985 Nguyen et al. ..... 187/29 R
5,135,081 8/1992 Watt et al. ..... 187/134

FOREIGN PATENT DOCUMENTS 2079002 1/1982 United Kingdom ..... B66B 1/28

*Primary Examiner*—Robert Nappi
*Attorney, Agent, or Firm*—Howard & Howard

[57] ABSTRACT

An apparatus for detecting excess speed of an elevator car travelling in an elevator shaft includes a vertically extending measuring strip is mounted at one side of the shaft and a multichannel forked light barrier assembly mounted on the car with a pair of legs extending on opposite sides of the strip. The measuring strip has a vertically extending markings track in the form of flags side-by-side with a check track, each of which is scanned by a separate light barrier transmitting a light beam between the legs of the forked light barrier assembly. At the position of each flag there is formed a window in the check track. The speed of the elevator car is measured by detecting the time required to pass each flag and the elevator car is stopped in the case of excess speed. By reason of the arrangement of the flag track and the check track, possible faults can be detected since one light barrier must always be interrupted by reason the flags and the windows.

15 Claims, 4 Drawing Sheets

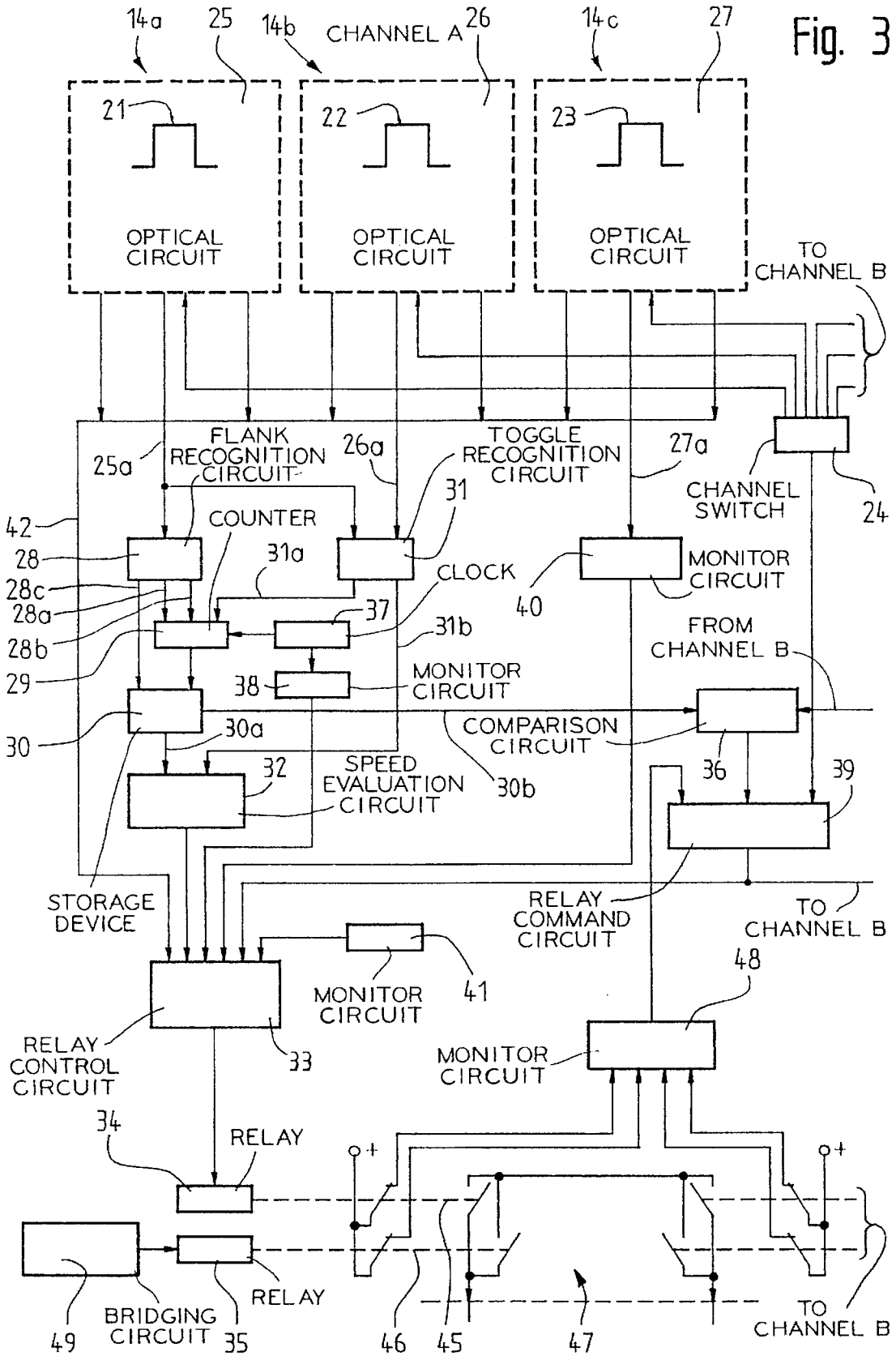
Fig. 3
14a
25
14b
CHANNEL A
26
14c
27
21
22
23
OPTICAL CIRCUIT
OPTICAL CIRCUIT
OPTICAL CIRCUIT
TO CHANNEL B
25a
FLANK RECOGNITION CIRCUIT
26a
TOGGLE RECOGNITION CIRCUIT
27a
CHANNEL SWITCH
24
42
COUNTER
31
28
31a
CLOCK
MONITOR CIRCUIT
28c
28a
37
40
28b
31b
FROM CHANNEL B
29
38
MONITOR CIRCUIT
30
30a
COMPARISON CIRCUIT
32
SPEED EVALUATION CIRCUIT
30b
36
39
STORAGE DEVICE
RELAY COMMAND CIRCUIT
TO CHANNEL B
MONITOR CIRCUIT
41
48
RELAY CONTROL CIRCUIT
33
MONITOR CIRCUIT
34
RELAY
RELAY
BRIDGING CIRCUIT
49
35
46
45
47
TO CHANNEL B

ELEVATOR EXCESS SPEED DETECTOR WITH MULTIPLE LIGHT BARRIER

BACKGROUND OF THE INVENTION

The present invention relates generally to an apparatus for controlling the movement of an elevator car and, in particular, to an apparatus for detecting excess speed of an elevator car.

In elevator systems, mechanical buffers are installed in the shaft pit as safety equipment. In case of failure of the elevator drive, the car upon travelling past the lowermost floor or the counterweight upon travelling past the uppermost floor is braked in defined manner. In the case of elevators with high nominal speeds, very large buffers are needed for this, which makes a deep shaft pit necessary and is correspondingly expensive to build. The elevator regulations permit only shortened buffers insofar as the retardation of the elevator car is monitored by an independent safety equipment. This retardation check must in the case of a fault make certain that the maximum permissible buffer impact speed, which in the case of shortened buffers is smaller than the nominal speed, is not exceeded.

Such an equipment for the speed monitoring and stop initiation, in particular for elevator cars, is shown in the U.S. Pat. No. 4,499,974. In this equipment, a flag track is mounted at one side of the elevator shaft. A detector, for example in the form of a forked light barrier, is fastened at the car. When the car travels through the shaft and the light beams of the light barrier are interrupted, the time of the interruption is measured. When the time of the interruption is smaller than a preset value, this is an indication of excess speed. The individual flags of the flag track are each so dimensioned that the preset passage times are fallen below and the safety switching elements are triggered when they are passed at more than the maximum permissible speed.

In the case of the aforedescribed equipment, the speed of the car is ascertained with the aid of a single measuring or checking equipment. It cannot be recognized whether the light barrier engages sufficiently deeply into the flags in order to assure an interruption of the light beams. The absence of the flag track or even only individual flags can likewise not be ascertained immediately thereby. Moreover, it cannot be recognized with this equipment without interrupting the current circuit, whether the working contacts of the safety switching elements function in order to make certain that they can actually be opened in the case of a fault.

SUMMARY OF THE INVENTION

The present invention concerns an apparatus for detecting excess speed of an elevator car travelling in an elevator shaft. The apparatus includes a speed measuring strip having an elongated body adapted to be mounted vertically extending in an elevator shaft, the strip having a vertically extending markings track side-by-side with a vertically extending check track, the markings track having a plurality of vertically spaced apart speed markings thereon and the check track having a plurality of check markings thereon in predetermined positions relative to the speed markings. The apparatus also includes a forked light barrier assembly adapted to be mounted on an elevator car movable in the elevator shaft, the assembly including a pair of legs extending on opposite sides of the speed measuring strip and a plurality of light barriers for transmitting beams of light between the legs. The assembly further includes an excess speed detection circuit connected to the light barriers and being responsive to a detection of the speed markings for generating a open relay signal to stop the car and being responsive to the speed markings and the check markings for generating the open relay signal when the speed markings and the check markings are not detected in a predetermined order.

The speed markings can be formed as flags and the check markings can be formed as windows, each window being positioned horizontally opposite an associated one of the flags. Also, the speed measuring strip can have a vertically extending safety track formed between the markings track and the check track and having a plurality of safety markings thereon formed as apertures. Alternatively, the speed markings and the check markings can be formed as windows and the windows of the check track can be arranged vertically in alternation with the windows of the markings track. Each of the light barriers is associated with one of two channels and corresponding ones of the light barriers in each channel perform similar functions to provide redundant detection of the speed markings and the check markings.

The present invention has as an object providing equipment for the ascertaining excess speed of an elevator car with a high degree of safety.

An advantage of the invention is that fault functions can be recognized and safety switching elements can be triggered by reason of the check track adjacent the flag track and a redundant forked light barrier.

Another advantage is, due to redundancy of the safety switching elements and a check circuit, faults of the safety relays can be recognized without interruption of the working current circuit.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is a schematic block diagram of the excess speed detector circuit associated with the forked light barrier assembly shown in the FIG. 1;

DESCRIPTION OF THE PREFERRED EMBODIMENT

Figure 1:
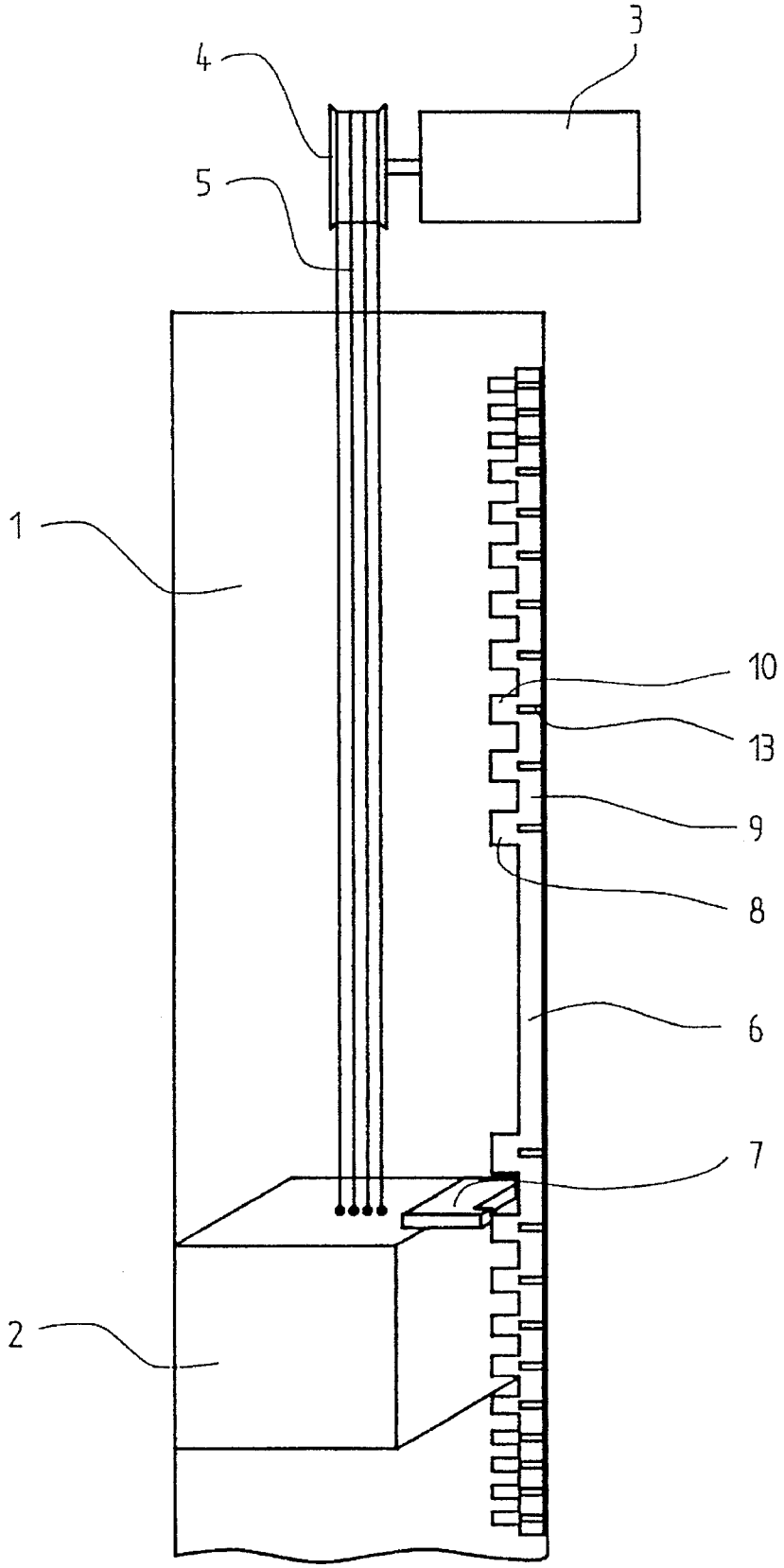
FIG. 1 is a schematic view of a elevator system having an excess speed detector apparatus according to the present invention.

There is shown in the FIG. 1 a schematic view of an elevator system with an apparatus according to the present invention for the detection of excess speed of an elevator car. An elevator car 2 is guided for vertical travel in an elevator shaft 1 and is supported by a plurality of cables 5 extending over a drive pulley 4 coupled to a drive motor 3. A vertically extending speed measuring strip 6 is mounted on one side wall of the elevator shaft 1 and extends in a plane perpendicular to a plane of the wall over the entire length of the shaft. A forked light barrier assembly 7 having multiple light barriers is attached to the car 2, preferably on the car roof. The measuring strip 6 has an elongated body which includes a vertically extending markings track formed as a flag track 8 adjacent a path of travel for the car 2 and a vertically extending check track 9 formed adjacent the wall of the shaft 1. The strip is made of a relatively strong material, preferably of steel sheet, to prevent bending and tearing. The forked light barrier assembly 7 includes a body which is generally U-shaped in plan view such that a pair of legs extend from a central portion along opposite sides of the measuring strip 6. Speed markings in the form of a plurality of flags 10 and check markings in the form of a plurality of windows 13 are formed in the measuring strip 6 for scanning by the forked light barrier 7. As shown, a window 13 is located in the check track 9 adjacent each of the flags 10 in the flag track 8. As described below, one light beam transmitted between the legs of the forked light barrier 7 is free to be tested when it is aligned with any one of the windows 13 in the check track 9. Other light beams transmitted between the legs and aligned with the flag track 8 are located relative to the one light beam such that at least one of the light beams is always interrupted as the elevator car 2 travels in the shaft 1. The vertical length of each of the flags 10 is matched to the maximum speed of the car 2, i.e. the flags become shorter towards the upper and lower ends of the shaft 1 where the maximum speed must be reduced.

When the legs of the forked light barrier 7 are not aligned with the flag track 8 or one of the flags 10 is missing, there is a fault condition and none of the light beams is blocked. In this state, the faults are recognized and the elevator safety switching elements are opened automatically by the elevator control to stop the car 2. Although rectangular flags 10 are shown in the FIG. 1, the shape of the markings on the measuring strip 6 can be different such as, for example, slots or holes, or the markings can be in a different medium such as reflecting and nonreflecting portions of the strip.

Figure 2:
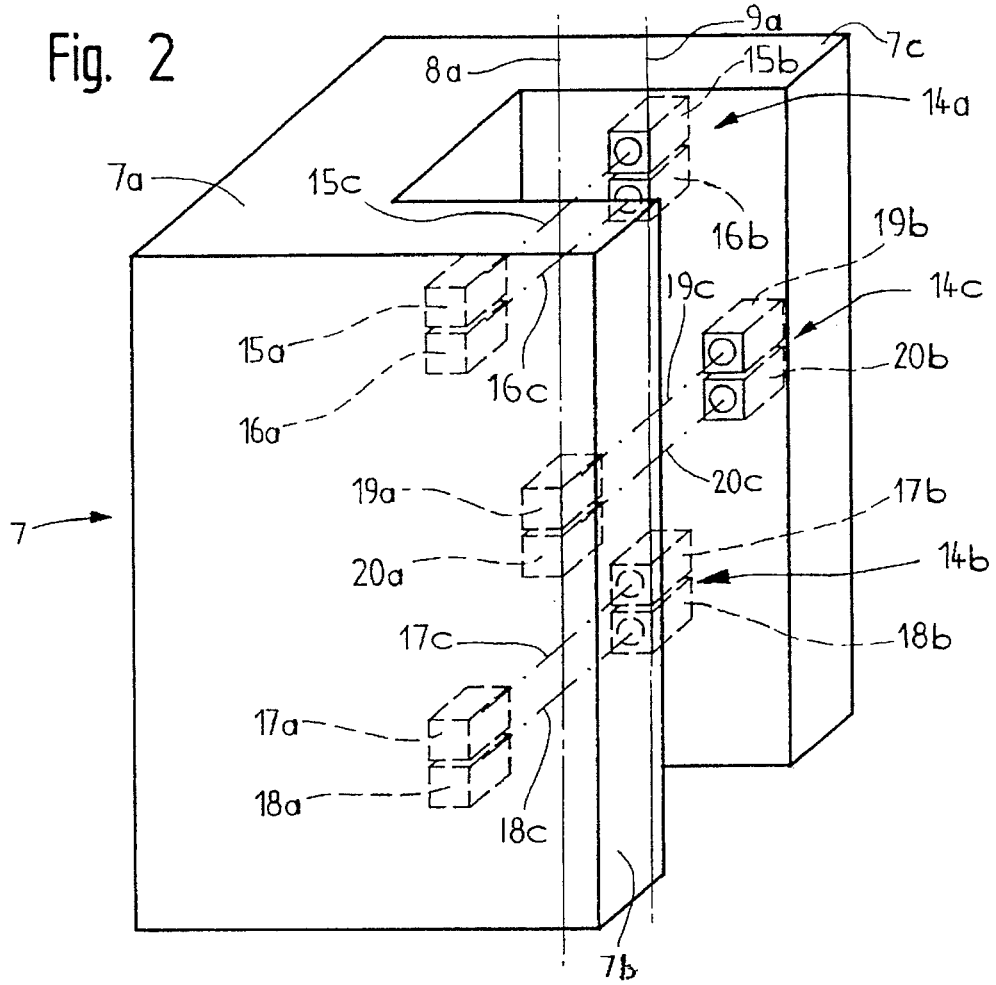
FIG. 2 is an enlarged perspective view of the forked light barrier assembly shown in the FIG. 1.

There is shown in the FIG. 2 the forked barrier assembly 7 which has a body with a central portion **7*a* and a pair of legs 7*b* and 7*c* extending from opposite sides of the central portion. The forked light barrier assembly 7 has two channels, designed as Channel A and Channel B, each channel having three, preferably infrared, light barriers which each transmit a beam of light between the legs 7*b* and 7*c*. An excess speed detection circuit shown in the FIG. 3 compares the state and the measurement results of both of the channels for generating output signals to the elevator control (not shown). A first light barrier 14*a* includes a Channel A optical transmitter 15*a* and a Channel B optical transmitter 16*a* mounted in the leg 7*b* and a Channel A optical receiver 15*b* and a Channel B optical receiver 16*b* mounted in the leg 7*c*. The transmitter 15*a* and the receiver 15*b* generate a light barrier or path 15*c* between them. The transmitter 16*a* and the receiver 16*b* also generate a light barrier or path 16*c* between them and the paths 15*c* and 16*c* are generally aligned vertically along a path of travel 8*a* of the assembly 7 which is aligned with a longitudinal axis of the flag track 8. The locations of the transmitters and receivers can be reversed in the legs and/or reversed in the vertical direction. The first light barrier 14*a* is aligned with the flag track 8 to measure the time required to pass each of the flags 10**.

A second light barrier **14*b* for each channel is displaced vertically from the first light barrier 14*a* in order to ascertain whether the flag 10 was passed or only touched as described below. The second light barrier 14*b* includes a Channel A optical transmitter 17*a* and a Channel B optical transmitter 18*a* mounted in the leg 7*b* and a Channel A optical receiver 17*b* and a Channel B optical receiver 18*b* mounted in the leg 7*c*. The transmitter 17*a* and the receiver 17*b* generate a light barrier or path 17*c* between them and the transmitter 18*a* and the receiver 18*b* generate a light barrier or path 18*c* between them and the paths 17*c* and 18*c* are generally aligned vertically along the path of travel 8*a* of the assembly 7**.

A third light barrier **14*c* for each channel is aligned vertically with a path of travel 9*a* of the check track 9 for ascertaining whether all flags 10 are present and whether the legs 7*b* and 7*c* of the forked light barrier 7 are mounted correctly with respect to the speed measuring strip 6. The third light barrier 14*c* includes a Channel A optical transmitter 19*a* and a Channel B optical transmitter 20*a* mounted in the leg 7*b* and a Channel A optical receiver 19*b* and a Channel B optical receiver 20*b* mounted in the leg 7*c*. The transmitter 19*a* and the receiver 19*b* generate a light barrier or path 19*c* between them and the transmitter 20*a* and the receiver 20*b* generate a light barrier or path 20*c* between them and the paths 19*c* and 20*c* are generally aligned vertically along the path of travel 9*a***.

Both channels of the forked light barrier assembly 7 provide the same functions with the light barriers of the Channel A being positioned directly above the associated light barriers of the Channel B. In order to exclude a mutual influencing among the associated light barriers of the two channels, only one transmitters is switched on at any time. Should a fault arise in the channel switching, the safety switching elements are opened and the car 2 is stopped. It is recognized as a faulty function when both the channels transmit at the same time or when the time requirement for the operation of a light barrier deviates from the normal value. Both the channels measure the flag passage time each independently of the other.

There is shown in the FIG. 3 shows a functional schematic block diagram of an excess speed detector circuit according the present invention. Only the Channel A is shown and described in detail since the Channel B is of identical construction. A channel switch 24 coordinates the turning on and off of the light barriers, i.e. the switching from one transmitter to the next in both the Channel A and the Channel B. The channel switch 24 has an individual output line connected to an input of each of a plurality of identical optical circuits such as optical circuits 25, 26 and 27 associated with the Channel A. The optical circuits 25, 26 and 27 include the transmitters **15*a*, 17*a* and 19*a* respectively, receivers 15*b*, 17*b* and 19*b* respectively, as well as a sequence control and transmitter and receiver test units (not shown) of the light barriers 14*a*, 14*b* and 14*c* respectively. The construction of such light barriers is described in the published European patent specification 483 560. The optical circuits 25 and 26 scan the flag track 8 for the flags 10. An output of the circuit 25 is connected to an input of a flank recognition circuit 28. When the circuit 25 detects a leading edge of a flag 10, it generates a detection signal 21 on the line 25*a* to the flank recognition circuit 28 which has a start count output connected to an input of a counter 29 by a line 28*a*. In response to the detection signal, the circuit 28 generates a start signal on the line 28*a* to the counter 29 which begins accumulating a count total. Upon passing a trailing edge of the flag 10, the signal 21 on the line 25*a* is terminated and the flank recognition circuit 28 generates a stop count signal at another output connected to another input of the counter 29 by a line 28***b* and the count is stopped. An output of the counter 29 is connected to an input of an intermediate storage device 30 and a store signal output of the flank recognition circuit 28 is connected to another input of the storage device 30 by a line 28*c*. When the counter 29 is stopped, the flank recognition circuit 28 generates the store count signal on the line 28*c* and the accumulated count total is stored in the storage device 30 and the counter is reset to zero. Thereby, the counter 29 is ready for the time measurement associated with the next flag 10 passed.

It is possible that the counter 29 is started at a flag leading edge due to toggling, i.e. oscillating upward and downward movements of the elevator car 1 relative to the measuring tape 6. In this case, the counter 29 is reset by a toggle recognition circuit 31 and the time measurement is recognized as being incorrect. The line 25*a* is also connected to an input of the toggle recognition circuit 31 which has a second input connected to a detection signal output of the optical circuit 26 by a line 26*a* for receiving a detection signal 22. The spacing between the light barriers 14*a* and 14*b* is less than the width of the narrowest flag 10. Therefore, if the Channel A light barriers 14*a* and 14*b* are passing a flag 10, the second one of the optical circuits 25 and 26 to detect the flag will begin generating its detection signal before the first optical circuit to detect the same flag terminates its detection signal. However, if toggling occurs, the toggle recognition circuit 31 will sense that one of the detection signals has been received and terminated before the other detection signal was received whereupon a reset signal is generated at an output connected to a reset input of the counter 29 by a line 31*a*.

When a correct flag passage has occurred, an evaluation of the count total is initiated by the toggle recognition circuit 31 which generates an evaluation signal at another output connected to an input of a speed evaluation circuit 32 by a line 31*b*. Another input of the evaluation circuit 32 is connected to an output of the intermediate storage device 30 by a line 30*a* to receive the count total. When the count value lies below a defined limit value, then the flag 10 was traversed too fast which is equivalent to excess speed of the car 2. In the case of excess speed, a speed fault signal is generated at an output of the circuit 32 to an input of a relay control circuit 33 to open a pair of safety relays 34 and 35 and the elevator car 2 is thus stopped. After a valid flag passage, the counter totals are available for both the Channel A and the Channel B. Differences between the counter totals are recognized by a comparison with a count difference tolerance in a comparison circuit 36. Another output of the storage device 30 is connected to an input of the comparison circuit 36 by a line 30*b*. The comparison circuit 36 has another input connected to the Channel B intermediate storage device to receive the Channel B count total and an output connected to an input of a relay command circuit 39. An output of the circuit 39 is connected to an input of relay control circuit 33 for generating a comparison fault signal to open the safety relays 34 and 35.

The counter 29 counts a constant rate which is controlled by a clock signal at a clock input connected to an output of a clock circuit 37 which generates the clock signal. A time base monitor circuit 38 has an input connected to another output of the clock circuit 37 for checking the counting rate. The circuit generates a time base fault signal at an output connected to another input of the circuit 33. An output of the optical circuit 27 is connected to an input of a check track monitor circuit 40 by a line 27*a* for receiving a detection signal 23. When a check track error is detected, the circuit 40 generates a check track fault signal at an output connected to another input of the circuit 33. A relay monitor circuit 41 checks relay reset pulses and generates a relay fault signal at an output connected to another input of the circuit 33. Optical errors can be detected by the receiver and transmitter test units (not shown) in the optical circuits 25, 26 and 27. Each test unit has an error signal output connected to an optical fault signal line 42 which is connected to another input of the relay control circuit 33. Should one of the aforementioned faults arise, the relay control circuit 33 responds to the associated fault signal to generate an open relay signal at an output connected to an input of the safety relays 34 and 35.

The relays 34 and 35 include pairs of switching contacts 45 and 46 respectively. The contacts in each pair are constrained to move together and one contact in each pair is connected to a working current circuit 47 for controlling movement of the elevator car 2. The other relay contact in each pair is connected between a power supply and a separate input of a relay state monitor circuit 48 for monitoring of the relays. The circuit 48 detects a faulty relay state and generates a relay switching-off signal at an output connected to another input of the relay command circuit 39. During the normal operation of the elevator system, no excess speed arises. Thus, the relays 34 and 35 never need to be switched off and their function can not be checked. In order to check the function of the safety relay contacts, these contacts must be opened without interrupting the working current circuit 47. For that reason, the two safety relays 34 and 35, the switching contacts 45 and 46 of which are connected in parallel, are duplicated for the Channel B. The function of the working contacts can be checked by a bridge circuit 49 having an output connected to an input of the relay 35 whereupon the working circuit contact of the relay 35 can be maintained closed while the other relay 34 is switched open. With the aid of the bridging-over of the working current circuit 47, this test becomes possible without opening the working current circuit.

Figure 4:
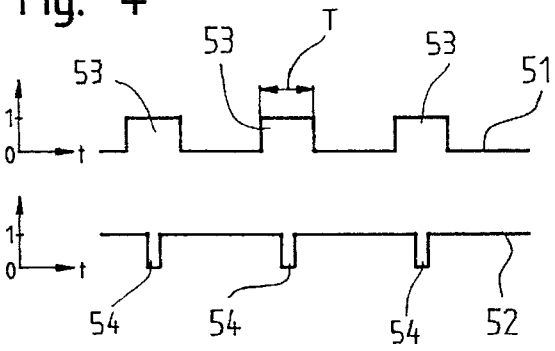
FIG. 4 is a waveform diagram of the signals generated by the optical circuits shown in the FIG. 3 during a fault-free operational state without excess speed.

There is shown in the FIG. 4 a waveform of the output signals from the optical circuits 25 and 27 in the fault-free operational state without excess speed. An upper waveform 51 represents the flag track signal and the lower waveform 52 represents the check track signal. During the movement of the light barrier 14*a* past the flags 10, a flag detection signal 53 is generated for each flag. The duration of the detection signal 53 is measured as a time T and a possible excess speed can be detected. Since each flag 10 has an associated window 13 positioned opposite it on the measuring strip 6, a check window recognition signal 54 is generated during each flag detection signal 53. The absence of a flag or a faulty positioning of the forked light barrier assembly 7 can be recognized at once when the check window recognition signal 54 and the flag detection signal 53 are not generated together.

Figure 5:
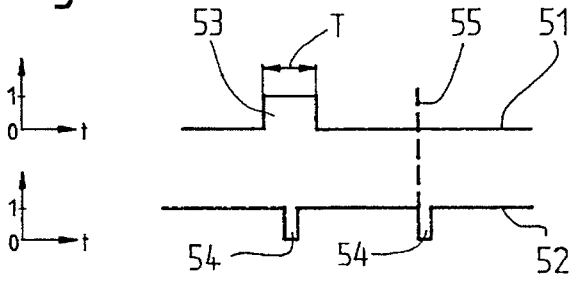
FIG. 5 is a waveform diagram of the signals generated by the optical circuits shown in the FIG. 3 during a faulty operational state.

There is shown in the FIG. 5 a waveform of the output signals from the optical circuits 25 and 27 in the case of an incorrect depth of engagement of the forked light barrier assembly 7 with the strip 6 or in the case of a missing flag 10. At a point 55, both of the light beams are received at the same time because a flag detection signal 53 is missing. The check track monitor circuit 40 and the flank recognition circuit 28 recognize the fault state at the point 55 and cause an opening of the safety relays 34 and 35. As soon as a fault arises, the channel which first discovers it releases its relays and the relay command circuit 39 generates the relay switching-off command to the other channel.

Figure 6:
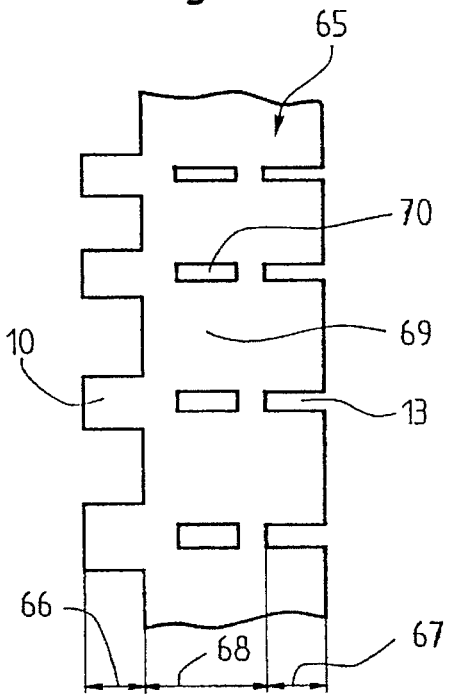
FIG. 6 is an enlarged fragmentary elevation view of a first alternate embodiment of the speed measuring strip shown in the FIG. 1.

In the FIG. 6 there is shown an alternate embodiment speed measuring strip 65 according to the present invention. The measuring strip 65 includes a markings track in the shape of a flag track 66 and a check track 67 which are similar to the tracks 8 and 9 and the arrangement of the flags 10 and the windows 13 is identical to the speed measuring strip 6 shown in the FIG. 1. However, the tracks 66 and 67 are separated by a safety track 68 which serves for additional checking in the upper and lower ends of the shaft 1. For this purpose, the measuring strip 65 has a portion 69 of the safety track 68 at the upper and the lower shaft ends thereof in which at least one safety marking in the form of an aperture 70, such as a slot or a hole, is formed. The forked light barrier assembly 7 then includes a fourth light barrier (not shown) similar to the light barrier 14*c* which can detect the end of the elevator shaft 1 by detecting the slot 70. This construction provides an additionally high operational reliability against faulty triggering such as, for example, in the case of possible contamination of the measuring strip 65 wherein the check windows 13 can no longer be detected by the light barrier 14*c*.

Figure 7:
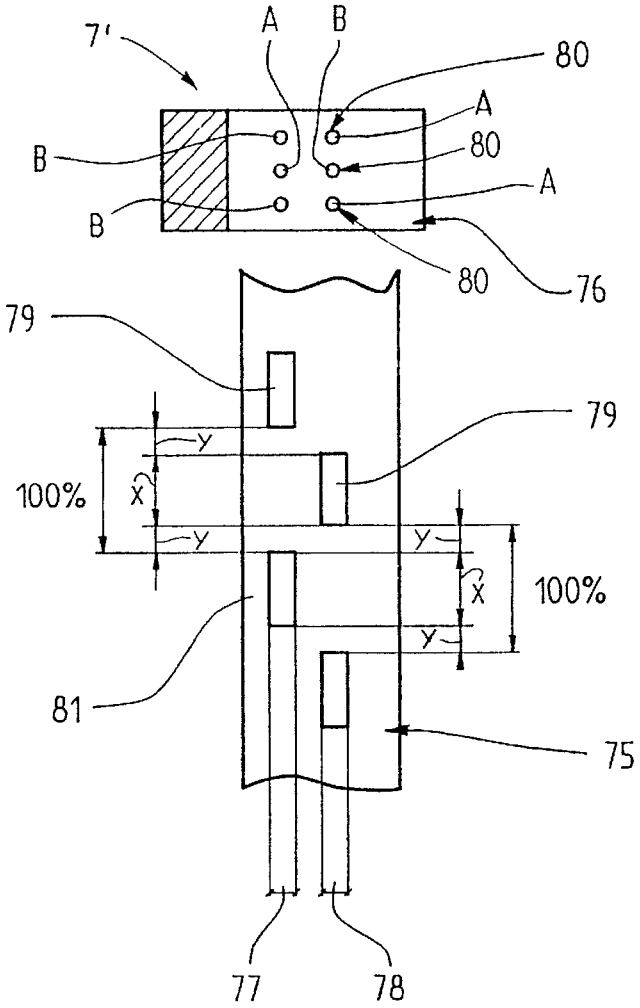
FIG. 7 is an enlarged fragmentary elevation view of a second alternate embodiment of the speed measuring strip shown in the FIG. 1 and a cross-sectional view through an alternate embodiment of the forked light barrier assembly shown in the FIG. 1.

There is shown in the FIG. 7 a second alternate embodiment speed measuring strip 75 and a cross section through an alternate embodiment forked light barrier assembly 76 according to the present invention. The measuring strip 75 includes a markings track in the form of a window track 77 and a check track 78. The window track 77 and the check track 78 each have a plurality of windows 79 formed therein. The windows 79 are of the same size and are arranged vertically such that alternate windows are in the same track. The spacing of the windows 79 is symmetrical such that if the vertical length of a window is "X", its upper and lower edges are spaced a vertical distance "Y" from the adjacent windows in the other track and the sum of the value of "X" and twice the value of "Y" is equal to 100% of the value of the spacing between adjacent windows in the same track. By reason of this arrangement of the windows 79, light barriers 80 of both the Channel A and the Channel B are arranged symmetrically. The detection can be due to the interruption of the light beams by the portion of the strip 75 between adjacent windows or by the transmission of the light beam through the windows. An advantage of this variant is that a contact safety device, which prevents a tearing-off of the measuring strip 75 by protruding parts of the elevator car 2, is formed by a web 81 between the window track 77 and an edge of the strip 75.

Figure 8:
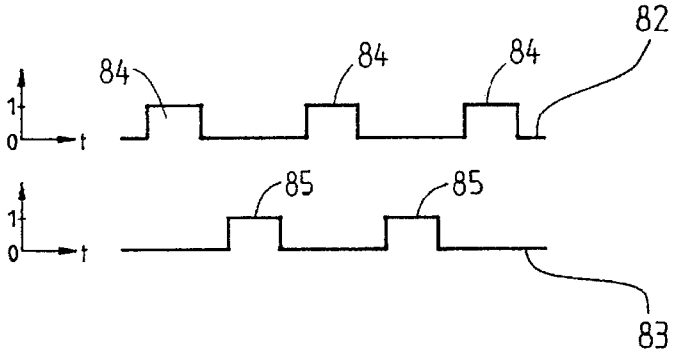
FIG. 8 is a waveform diagram of the signals generated by the optical circuits in the forked light barrier assembly shown in the FIG. 7.

There is shown in the FIG. 8 a waveform of the signals generated by the light barriers 80 during a fault-free operational state. An upper waveform 82 is a window track signal having a plurality of window detection signals 84 and a lower waveform 83 is a check track signal having a plurality of check window recognition signals. The detection of excess speed takes place in the same manner as described above in connection with the waveforms shown in the FIG. 4. Faults can be recognized when a pulse is absent or a channel has a constant "0" or constant "1" signal level.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for detecting excess speed of an elevator car travelling in an elevator shaft comprising:

a speed measuring strip having an elongated body adapted to be mounted vertically extending in an elevator shaft, said strip having a vertically extending markings track side-by-side with a vertically extending check track, said markings track having a plurality of vertically spaced apart speed markings thereon and said check track having a plurality of check markings thereon in predetermined positions relative to said speed markings;

a forked light barrier assembly adapted to be mounted on an elevator car movable in the elevator shaft, said assembly including a pair of legs extending on opposite sides of said speed measuring strip and a plurality of light barriers for transmitting beams of light between said legs; and an excess speed detection circuit connected to said light barriers and being responsive to a detection of said speed markings for generating a open relay signal to stop the car, said excess speed detection circuit being responsive to said speed markings and said check markings for generating said open relay signal when said speed markings and said check markings are not detected in a predetermined order.

2. The apparatus according to claim 1 wherein said speed markings are formed as flags and said check markings are formed as windows, each said window being positioned horizontally opposite an associated one of said flags.

3. The apparatus according to claim 1 wherein said speed markings and said check markings are formed as windows and said windows of said check track are arranged vertically in alternation with said windows of said markings track.

4. The apparatus according to claim 1 wherein said speed measuring strip has a vertically extending safety track formed between said markings track and said check track and having a plurality of safety markings thereon.

5. The apparatus according to claim 4 wherein said safety markings are formed as apertures.

6. The apparatus according to claim 1 wherein each of said light barriers is associated with one of two channels and corresponding ones of said light barriers in each said channel perform similar functions to provide redundant detection of said speed markings and said check markings.

7. The apparatus according to claim 6 wherein said plurality of light barriers includes at least a first and a second light barrier for each said channel, said second light barrier being vertically spaced from said first light barrier for detecting said speed markings.

8. The apparatus according to claim 6 wherein said light barriers associated with one of said channels detect said speed markings independently of said light barriers associated with another of said channels.

9. The apparatus according to claim 6 wherein said speed markings and said check markings are formed as windows, said windows of said check track are arranged vertically in alternation with said windows of said markings track, and said light barriers are arranged symmetrically for detecting said windows.

10. The apparatus according to claim 1 wherein said excess speed detection circuit includes a channel switch connected to said light barriers for switching each of said light barriers on and off at a different time.

11. The apparatus according to claim 1 wherein said excess speed detection circuit is connected to a pair safety relays, each said relay having a pair of switch contacts with corresponding ones of said switch contacts being connected in parallel, one said contact of each said relay being connected to a working current circuit for the elevator car, each of said relays being responsive to said open relay signal for opening said one contact.

12. An apparatus for detecting excess speed of an elevator car travelling in an elevator shaft comprising:

a speed measuring strip having an elongated body adapted to be mounted vertically extending in an elevator shaft, said strip having a vertically extending markings track side-by-side with a vertically extending check track, said markings track having a plurality of vertically spaced apart speed markings thereon and said check track having a plurality of check markings thereon in predetermined positions relative to said speed markings;

a forked light barrier assembly adapted to be mounted on an elevator car movable in the elevator shaft, said assembly including a pair of legs extending on opposite sides of said speed measuring strip and a plurality of light barriers for transmitting beams of light between said legs, each of said light barriers being associated with one of two channels and corresponding ones of said light barriers in each said channel performing similar functions to provide redundant detection of said speed markings and said check markings; and an excess speed detection circuit connected to said light barriers and being responsive to a detection of said speed markings for generating a open relay signal to stop the car, said excess speed detection circuit being responsive to said speed markings and said check markings for generating said open relay signal when said speed markings and said check markings are not detected in a predetermined order.

13. The apparatus according to claim 12 wherein said excess speed detection circuit includes a toggle recognition circuit connected to said light barriers for detecting oscillating upward and downward movements of the elevator car and generating said open relay signal.

14. The apparatus according to claim 12 wherein said excess speed detection circuit includes a comparison circuit connected to said light barriers for detecting a difference between rates of detecting said speed markings by said two channels and generating said open relay signal.

15. An elevator system comprising:

an elevator car movable in an elevator shaft;

a speed measuring strip having an elongated body mounted vertically extending in said elevator shaft, said strip having a vertically extending markings track side-by-side with a vertically extending check track, said markings track having a plurality of vertically spaced apart speed markings thereon and said check track having a plurality of check markings thereon in predetermined positions relative to said speed markings;

a forked light barrier assembly mounted on said elevator car movable in said elevator shaft, said assembly including a pair of legs extending on opposite sides of said speed measuring strip and a plurality of light barriers for transmitting beams of light between said legs;

an excess speed detection circuit connected to said light barriers and being responsive to a detection of said speed markings for generating a open relay signal to stop the car, said excess speed detection circuit being responsive to said speed markings and said check markings for generating said open relay signal when said speed markings and said check markings are not detected in a predetermined order; and a safety means connected between said car and said excess speed detection circuit and being responsive to said open relay signal for stopping movement of said elevator car in said shaft.

* * * * *